US007553241B2

(12) United States Patent
Park et al.

(10) Patent No.: US 7,553,241 B2
(45) Date of Patent: Jun. 30, 2009

(54) SET OF GOLF CLUBS

(75) Inventors: Sharon J. Park, Irvine, CA (US); Nathaniel J. Radcliffe, Huntington Beach, CA (US); Daniel J. Stone, Long Beach, CA (US); Brad S. Hooley, Huntington Beach, CA (US); Robert J. Horacek, Hermosa Beach, CA (US); Sam G. Lacey, Huntington Beach, CA (US); Kevin Schaeffer, Vienna, VA (US); Craig R. Schnell, Carlsbad, CA (US); Douglas E. Roberts, Carlsbad, CA (US); Jimmy H. Kuan, West Covina, CA (US); John J. Rae, Huntington Beach, CA (US); Dan S. Nivanh, Huntington Beach, CA (US); Andrew P. Chick, Solon, OH (US)

(73) Assignee: Roger Cleveland Golf Co., Inc., Huntington Beach, CA (US)

( * ) Notice: Subject to any disclaimer, the term of this patent is extended or adjusted under 35 U.S.C. 154(b) by 0 days.

(21) Appl. No.: 11/730,714

(22) Filed: Apr. 3, 2007

(65) Prior Publication Data

US 2008/0051210 A1 Feb. 28, 2008

(51) Int. Cl.
*A63B 53/04* (2006.01)

(52) U.S. Cl. ..... 473/290; 473/346

(58) Field of Classification Search ..... 473/290–291, 473/350, 345–346

See application file for complete search history.

(56) References Cited

U.S. PATENT DOCUMENTS 1,524,731 A 2/1925 Davis
1,525,137 A 2/1925 Lawton
1,532,545 A 4/1925 Pedersen
1,647,487 A 11/1927 Vernon
D140,085 S 1/1945 Myers et al.
D208,058 S * 7/1967 Ota ..... D21/747
4,420,156 A * 12/1983 Campau ..... 473/291
4,521,022 A * 6/1985 Schmidt ..... 473/330
4,645,207 A * 2/1987 Teramoto et al. ..... 473/290
4,754,969 A * 7/1988 Kobayashi ..... 473/290
5,184,823 A * 2/1993 Desboilles et al. ..... 473/345
5,333,873 A 8/1994 Burke
D350,800 S * 9/1994 Ota ..... D21/747

(Continued)

*Primary Examiner*—Stephen L. Blau
(74) *Attorney, Agent, or Firm*—Oliff & Berridge, PLC

(57) ABSTRACT

At least three clubs of a set of golf clubs may have an average volume between about 75 $cm^3$ and about 90 $cm^3$. The transverse dimensions of the at least three clubs may progressively decrease from a highest volume club to a lowest volume club. At least one club of a set may include a constraining member in a cavity. A linear distance between a sweet spot and a center of gravity may progressively decrease from a lower lofted club to a higher lofted club within a set. At least one golf club of a set may include a face plate portion, and at least two golf clubs of the set may include a cup face portion. At least two clubs of a set may include a progressively increasing hosel length from a lowest lofted club to a highest lofted club. The strike face of at least one club of a set may include a bulge and a roll. A first club of a set may have a face thickness that is less than a face thickness of a second club of the set.

5 Claims, 19 Drawing Sheets

U.S. PATENT DOCUMENTS 5,976,029 A * 11/1999 Sherwood ..... 473/291
5,984,803 A * 11/1999 Chappell ..... 473/291
6,139,445 A 10/2000 Werner et al.
D466,960 S 12/2002 Imamoto
D468,788 S 1/2003 Bode et al.
D469,832 S 2/2003 Bode et al.
6,551,200 B1 * 4/2003 Golden et al. ..... 473/349
6,835,144 B2 * 12/2004 Best ..... 473/332
2003/0228928 A1 * 12/2003 Yabu ..... 473/290
2004/0185960 A1 * 9/2004 Chen ..... 473/342
2005/0014573 A1 * 1/2005 Lee ..... 473/291
2005/0192116 A1 * 9/2005 Imamoto ..... 473/329
2005/0239569 A1 * 10/2005 Best et al. ..... 473/290
2006/0073912 A1 * 4/2006 Hsieh et al. ..... 473/350
2008/0058120 A1 * 3/2008 Roberts et al. ..... 473/350

* cited by examiner

SET OF GOLF CLUBS

BACKGROUND

Over time, iron-type golf clubs evolved from the difficult-to-hit blade-type irons to the more forgiving cavity-back designs. Despite improvements in club head performance, cavity-back irons still share many of the shortcomings associated with traditional blade-type irons. For example, relatively narrow soles of the blade-type and cavity-back irons tend to "dig in" the ground during a golf swing, which may reduce shot accuracy and overall distance.

Shot accuracy and distance are also affected by the depth of the center of gravity of the club head relative to its strike face. In most irons, the center of gravity is typically positioned near the strike face. This shallow center of gravity placement does not allow sufficient dynamic flexing of the shaft toward alignment with the club head's center of gravity on the downswing to loft and square the strike face at impact with the ball. Thus, shallow center of gravity placement makes it more difficult to get the golf ball in the air and may result in hook/slice tendencies.

Oversized iron-type club heads having wider soles were intended to address these problems. Some of these club heads have a hollow construction similar to hybrid or wood-type club heads. The wider soles of such club heads increase the center of gravity depth and reduce the "digging in" effect associated with the blade-type and cavity-back irons. However, due to swing-weight considerations, the degree to which the sole of an iron-type club may be widened is limited. The added weight associated with a wider sole may feel excessive to an average golfer, ultimately affecting the golfer's confidence and enjoyment of the golf club.

Additionally, the wider soles and non-traditional club shapes of the oversized irons may negatively affect the sound produced at impact. Acoustics play an important role in the golfer's confidence and enjoyment of the golf club. Although the club head may impact a ball at or near the center, or "sweet" spot, of the face, the golfer may associate unpleasant aural characteristics with an off-center hit, become discouraged, and lose confidence in the club head. The loss in confidence may result in decreased shot accuracy and distance.

SUMMARY

A need exists for a set of golf clubs having favorable acoustic characteristics, reduced hook/slice tendencies, improved dynamic loft attributes at ball impact, diminished propensity to "dig in," increased coefficient of restitution, and/or a swing weight conducive to bolstering the golfer's confidence in the equipment.

Each club of a set according to an example of the invention may include a shell portion, a face member comprising a striking surface, a loft of at least 20°, and a transverse dimension. At least three golf clubs of the set may have different volumes, the average volume being between about 75 $cm^3$ and about 90 $cm^3$. The transverse dimension of the at least three clubs may progressively decrease from the highest volume club to the lowest volume club.

In another example of the present invention, at least three clubs of a set may have different lofts. The transverse dimension of the at least three clubs may progressively decrease from the lowest lofted club to the highest lofted club. At least one club of the set may have two or more articulation points.

In an exemplary club set according to the present invention, each club of a set may include a shell portion having a concavity, a face member comprising a striking surface, and a loft of at least 20°. The striking surface of at least two clubs of the set may include a bulge and a roll.

In an exemplary set of clubs in accordance with the present invention, each club of the set may include a shell portion having a concavity, a face member comprising a striking surface, a cavity at least in part bounded by the shell portion and the face member, and a loft of at least 20°. At least one club of the set may include a constraining member in the cavity.

Each club of an exemplary set according to the present invention may include a shell portion, a face member comprising a striking surface, a center of gravity, a sweet spot located a linear distance away from the center of gravity, and a loft of at least 20°. At least three clubs of the set may have different lofts, and the linear distance between the sweet spot and the center of gravity may progressively decrease from the lowest lofted club to the highest lofted club.

Each club of an exemplary set in accordance with the present invention may include a shell portion, a face member comprising a striking surface, a center of gravity, a sweet spot located a linear distance away from the center of gravity, and a loft of at least 20°. The linear distance between the sweet spot and the center of gravity may be from about 16 mm to about 20 mm for at least one first club of the set, from about 11 mm to about 16 mm for at least one second club of the set, and from about 6 mm to about 11 mm for at least one third club of the set.

Each club of an exemplary set in accordance with the present invention may include a shell portion, a face member comprising a striking surface, a cavity at least in part bounded by the shell portion and the striking surface, and a loft of at least 20°. The face member of at least one golf club of the set may comprise a strike plate and the face member of at least two golf clubs of the set may comprise a cup face.

The various exemplary aspects described above may be implemented individually or in various combinations.

These and other features, aspects, and advantages of the set of golf clubs according to the invention in its various aspects and demonstrated by one or more of the various examples will become apparent after consideration of the ensuing description, the accompanying drawings, and the appended claims.

BRIEF DESCRIPTION OF THE DRAWINGS

The drawings described below are for illustrative purposes only and are not intended to limit the scope of the present invention in any way. Exemplary implementations will now be described with reference to the accompanying drawings, wherein.

In the figures, like elements are designated by like reference numerals.

DESCRIPTION

The following examples will be described using one or more definitions, provided below.

Figure 1A:
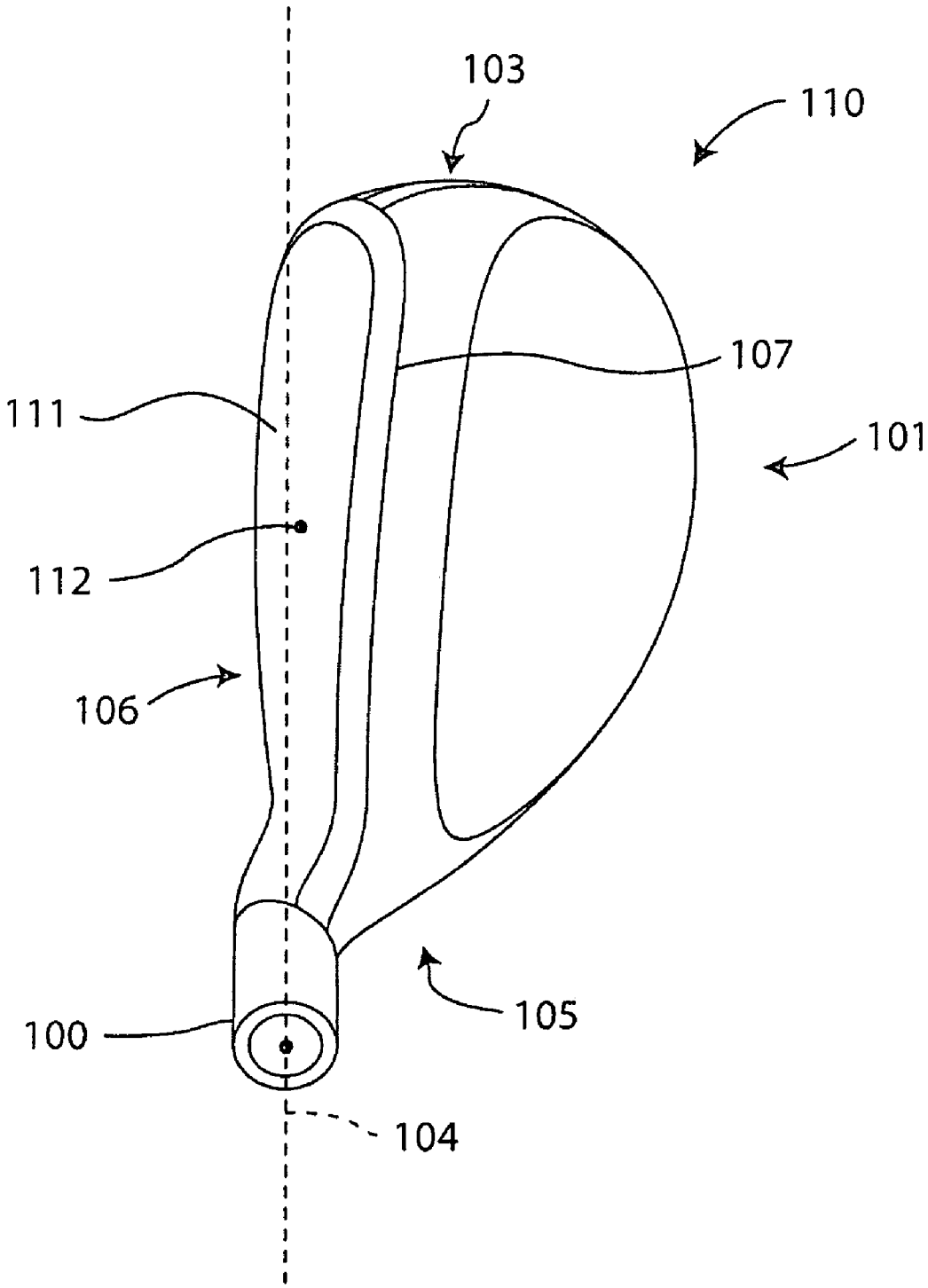
FIG. 1A is a top plan view of an exemplary golf club in accordance one aspect of the invention.
Figure 1B:
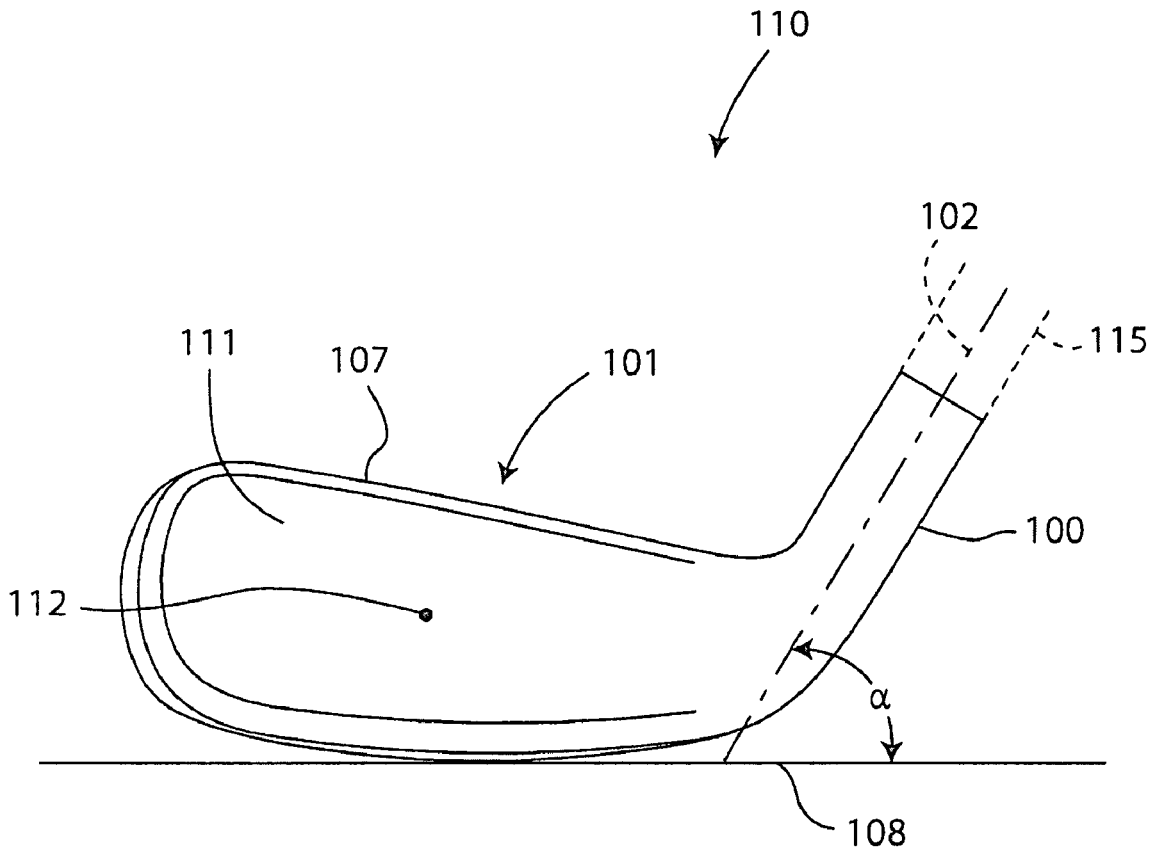
FIG. 1B is a front elevational view of the golf club of FIG. 1.
Figure 3:
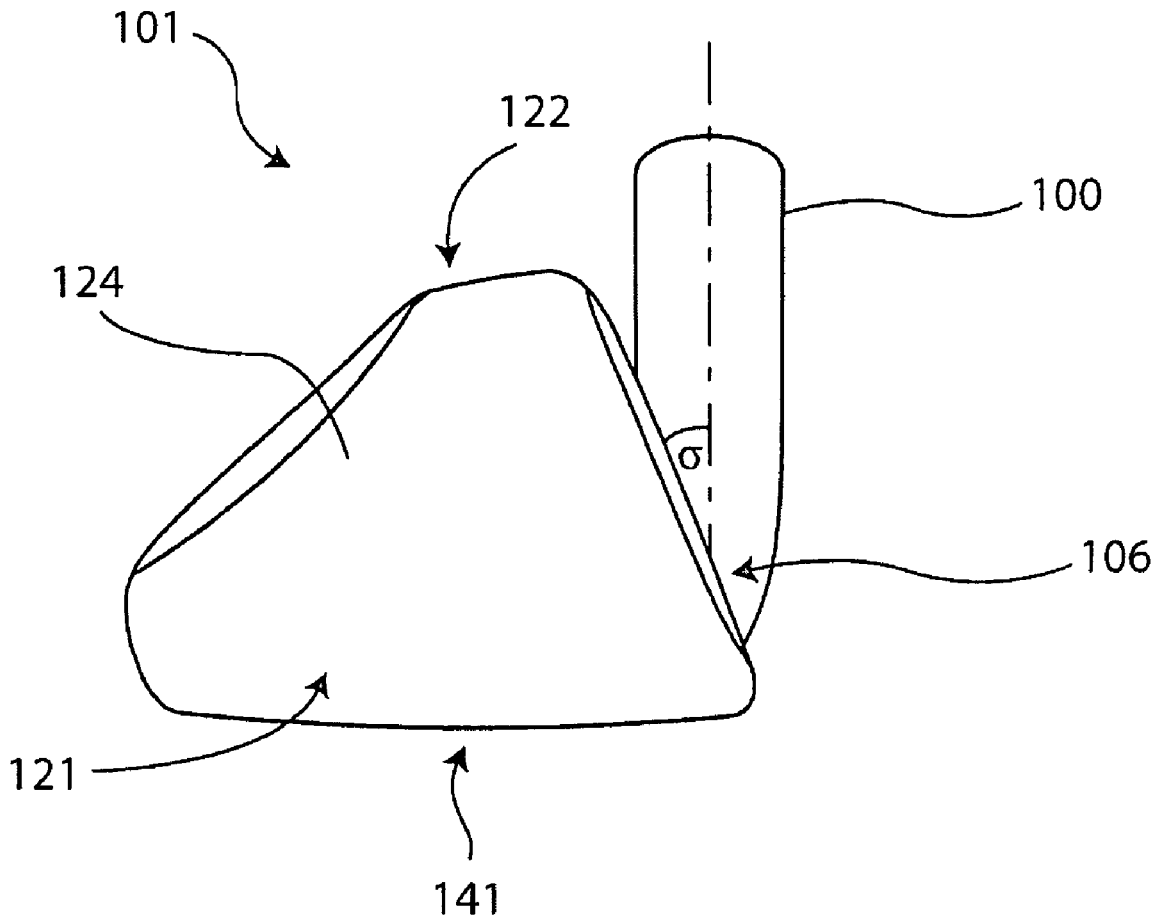
FIG. 3 is a toe side elevational view of the golf club of FIG. 1.

Referring to FIGS. 1A and 1B, a golf club 110 may comprise a club head 101 having a toe 103, a heel 105, a hosel 100 having a central axis (centerline) 102, and a face member 106, the face member 106 including a striking surface 111, a top edge 107, and a face center 112. The striking surface 111 has a loft angle σ (FIG. 3). Golf club 110 and all other golf clubs described and illustrated herein may further include a shaft 115 having a grip (not shown).

"Reference position," as used herein, denotes a position of the club head 101 with the face "squared" and with the hosel centerline 102 oriented at the club head's actual lie angle α. The face is "squared" when an imaginary vertical plane 104, including the hosel centerline 102, is substantially parallel to the top edge 107. Unless otherwise indicated, all parameters below will be specified with the club head 101 in the reference position.

Referring again to FIGS. 1A and 1B, "face center," e.g., the face center 112, as used herein, is defined in accordance with the USGA's (U.S. Golf Association's) "Procedure for Measuring the Flexibility of a Golf Club Head," Revision 2.0, Section 6.1 (Mar. 25, 2005).

Figure 2:
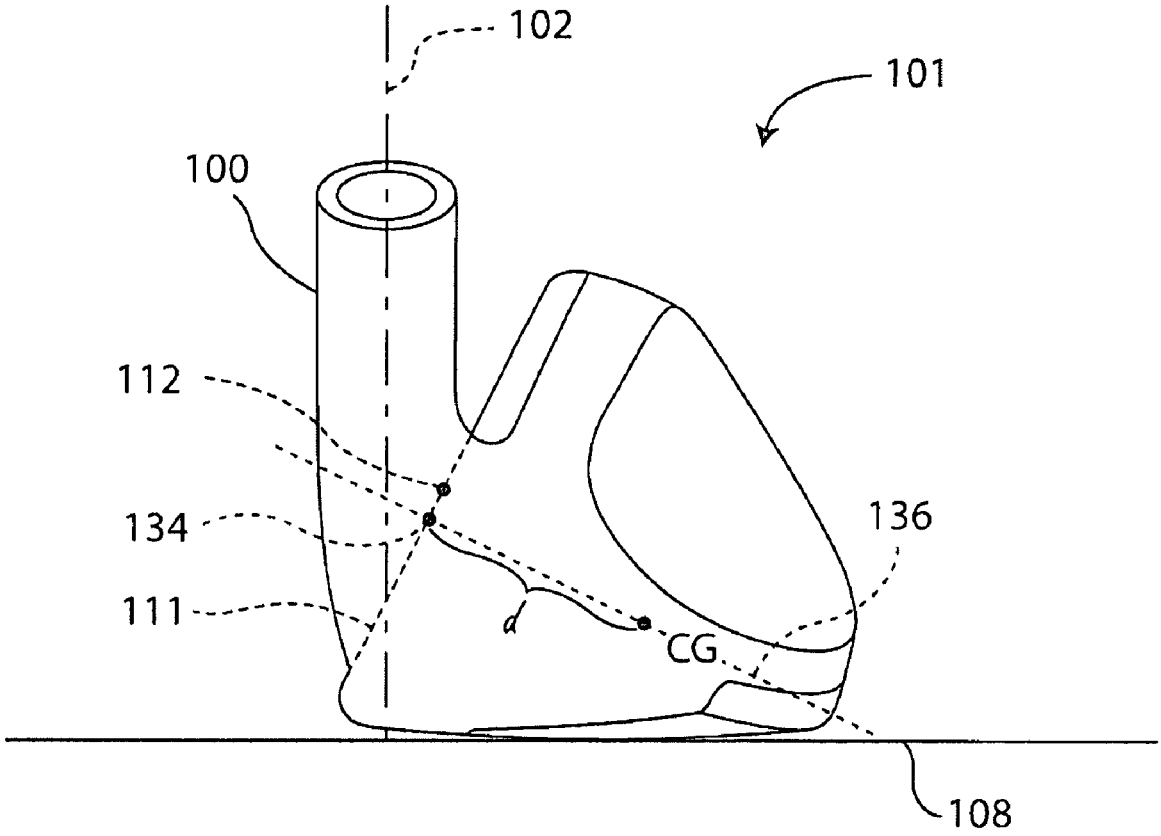
FIG. 2 is a heel side elevational view of the golf club of FIG. 1.

Referring to FIG. 2, "sweet spot," e.g., the sweet spot 134, as used herein, refers to the point of intersection between the outer surface of the striking surface 111 and an imaginary line 136 that is substantially perpendicular to the striking surface 111 and passes through the center of gravity CG of the club head 101.

Figure 9A:
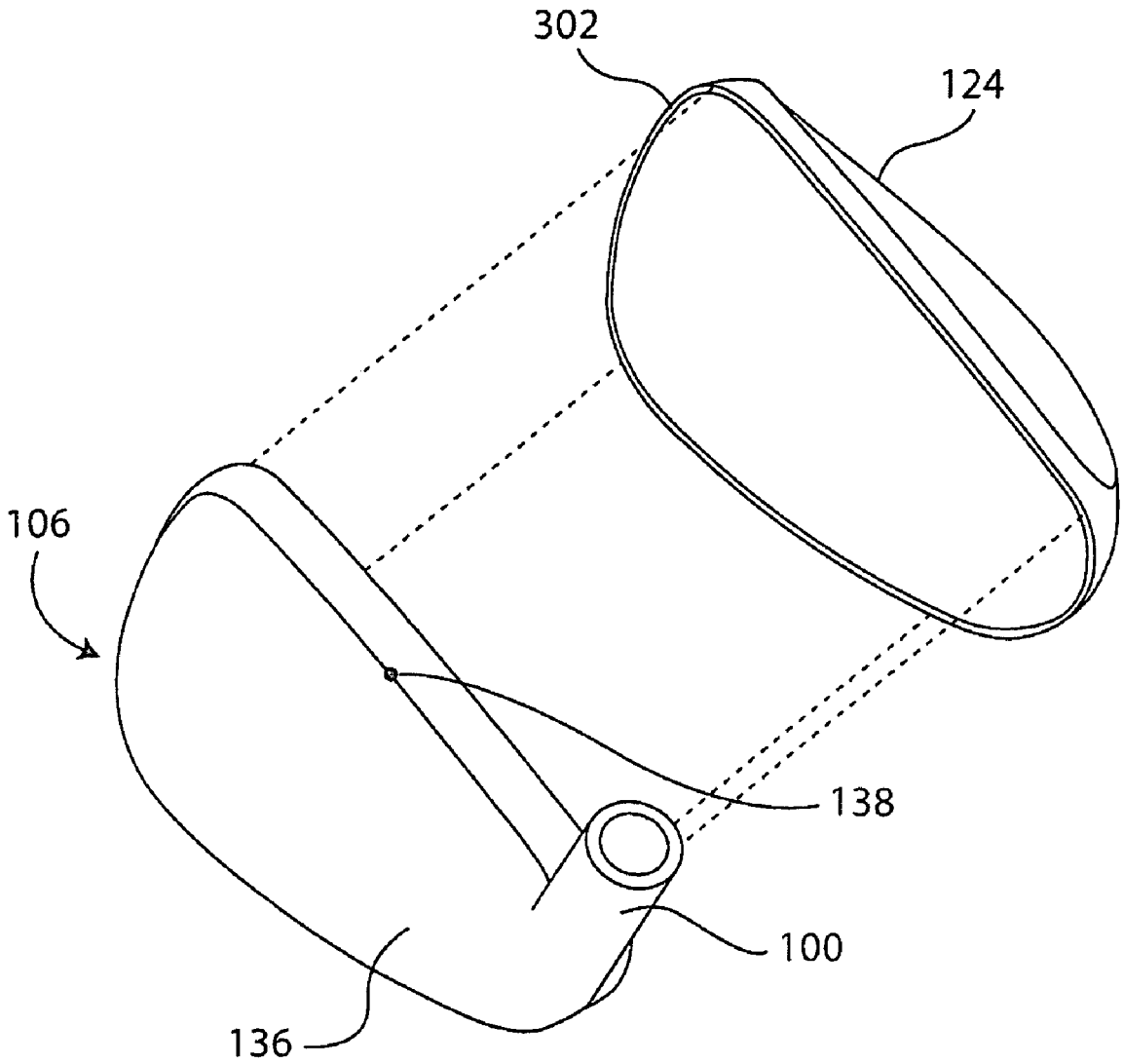
FIGS. 9A and 9B are exploded views of an exemplary golf club in accordance with another aspect of the invention.

Referring to FIGS. 3 and 9A, "shell," e.g., the shell 124, as used herein, refers to the portion of the club head 101 that is associated with the face member 106. The shell may include a crown 122, a sole 141, a skirt 121, and/or the hosel 100.

Figure 4:
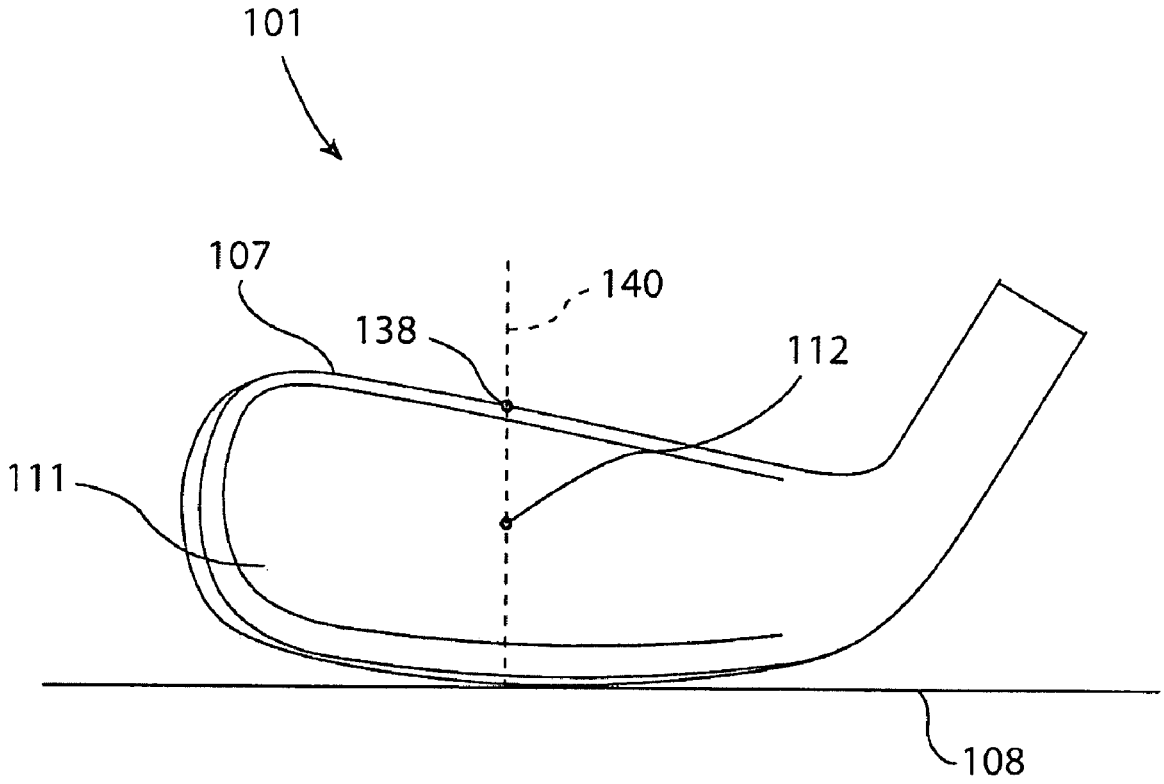
FIG. 4 is a front elevational view of the golf club of FIG. 1.

Referring to FIG. 4, "center apex," e.g., the center apex 138, as used herein, denotes the point of intersection between an imaginary vertical plane 140 and the top edge 107. The plane 140 is substantially perpendicular to the top edge 107 and passes through the face center 112.

Figure 5:
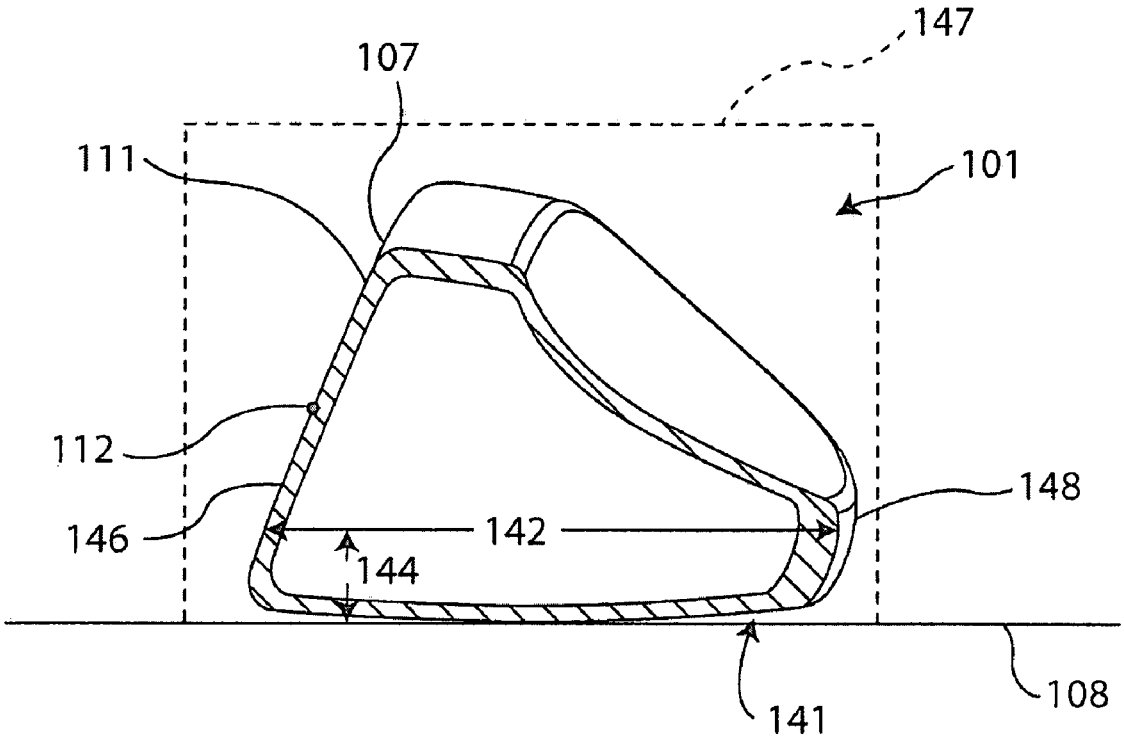
FIG. 5 is a heel side cross-sectional view of the golf club of FIG. 1.

Referring to FIG. 5, "transverse dimension," e.g., the transverse dimension 142, as used herein, denotes a horizontal distance, at a vertical height 144 from about 2 mm to about 10 mm above a ground plane 108, in a direction substantially perpendicular to the top edge 107, between an imaginary line 146 and the outer surface of a rear portion 148 of the club head 101. The imaginary line 146 is characterized by the intersection of an imaginary vertical plane 147, substantially perpendicular to the top edge 107 and passing through the face center 112, with the striking surface 111.

Figure 6A:
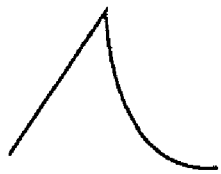
FIGS. 6A-6F illustrate examples of non-arcuate junctions in accordance with another aspect of the invention.
Figure 6B:
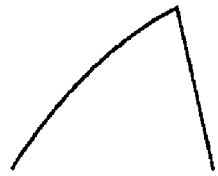
Figure 6C:
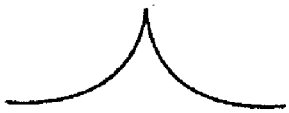
Figure 6D:
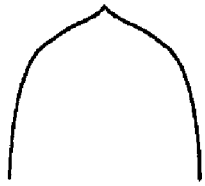
Figure 6E:
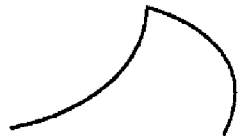
Figure 6F:
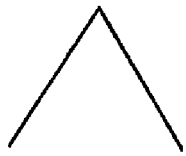

The term "non-arcuate junction," as used herein, refers to a junction of two lines where an arcuate line intersects a straight line (FIGS. 6A and 6B), an arcuate line intersects another arcuate line (FIGS. 6C, 6D and 6E), or a straight line intersects another straight line (FIG. 6F).

Figure 7A:
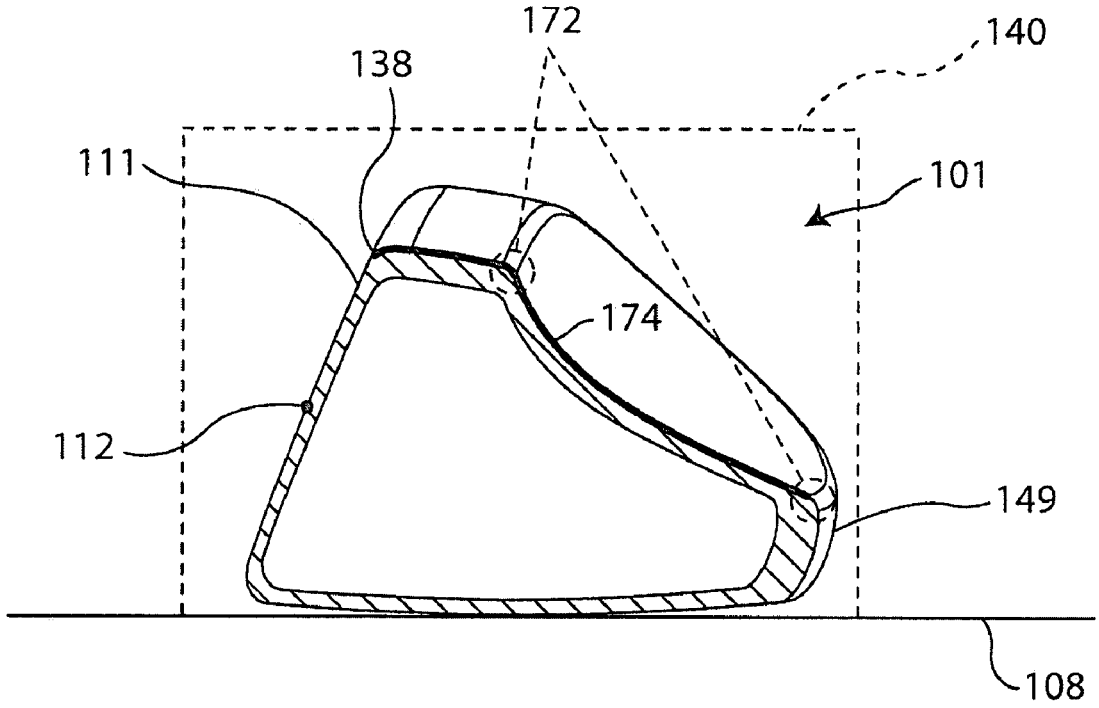
FIG. 7A is a heel side cross-sectional view of an exemplary golf club in accordance with another aspect of the invention.
Figure 7B:
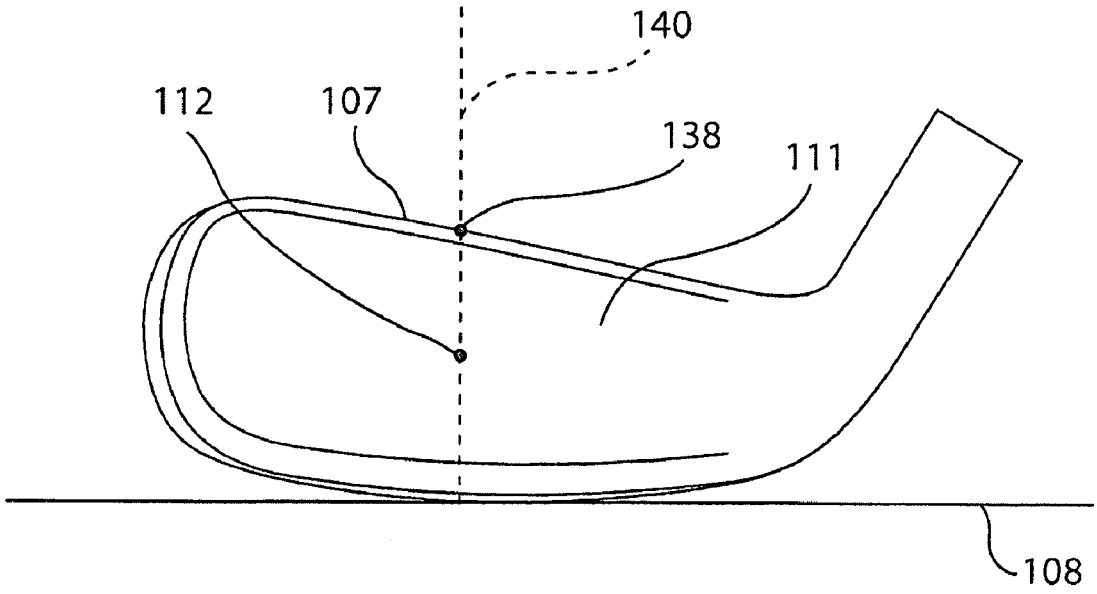
FIG. 7B is a front elevational view of the golf club of FIG. 7A.
Figure 7C:
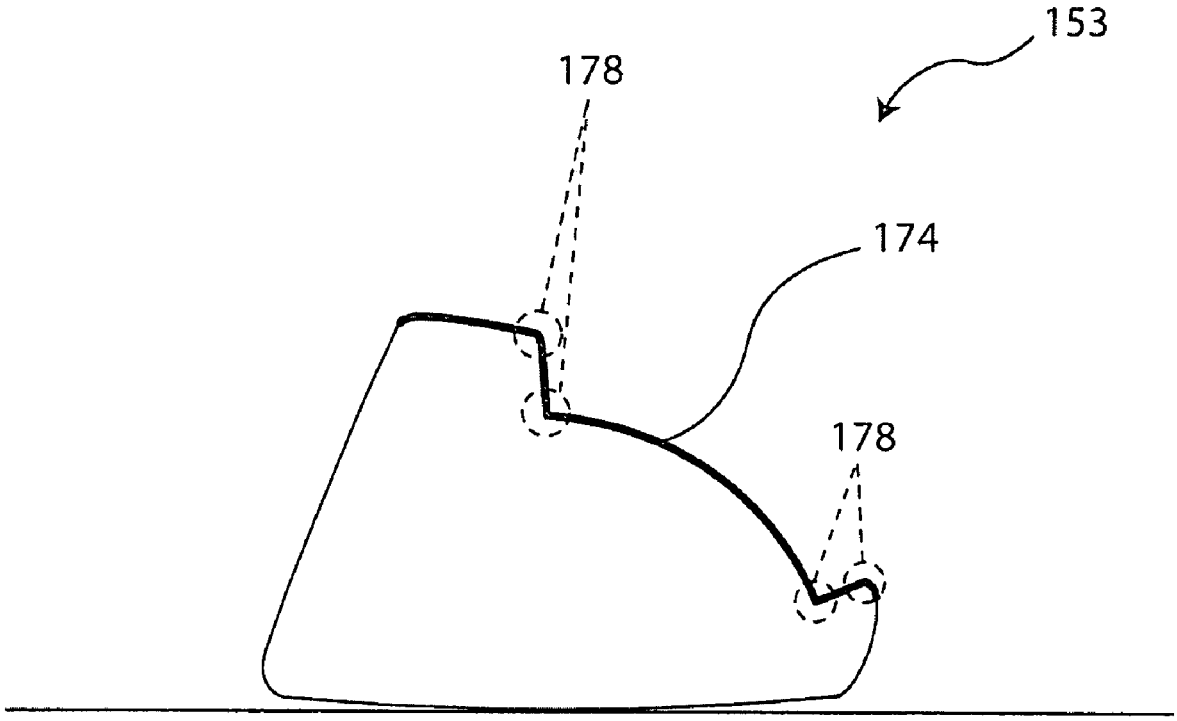
FIG. 7C is a heel side schematic view of an exemplary golf club in accordance with another aspect of the invention.
Figure 7D:
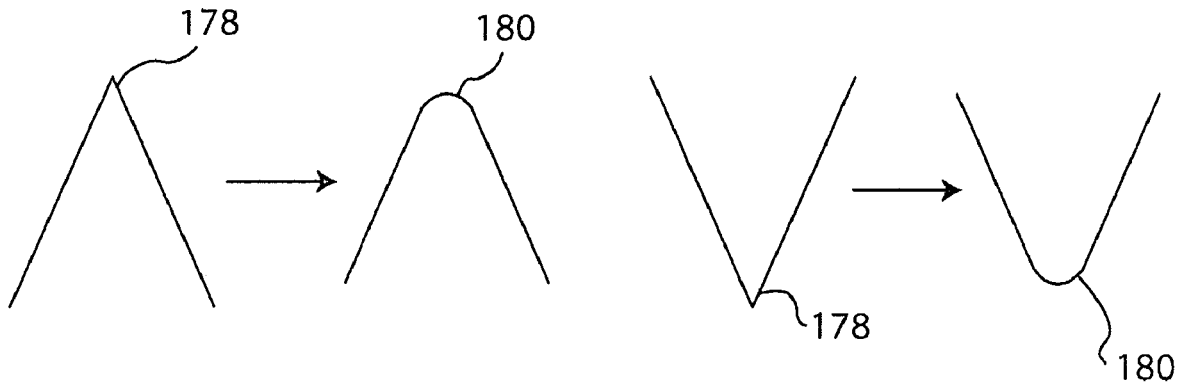
FIG. 7D illustrates the non-arcuate junction of FIG. 6F.
Figure 7E:
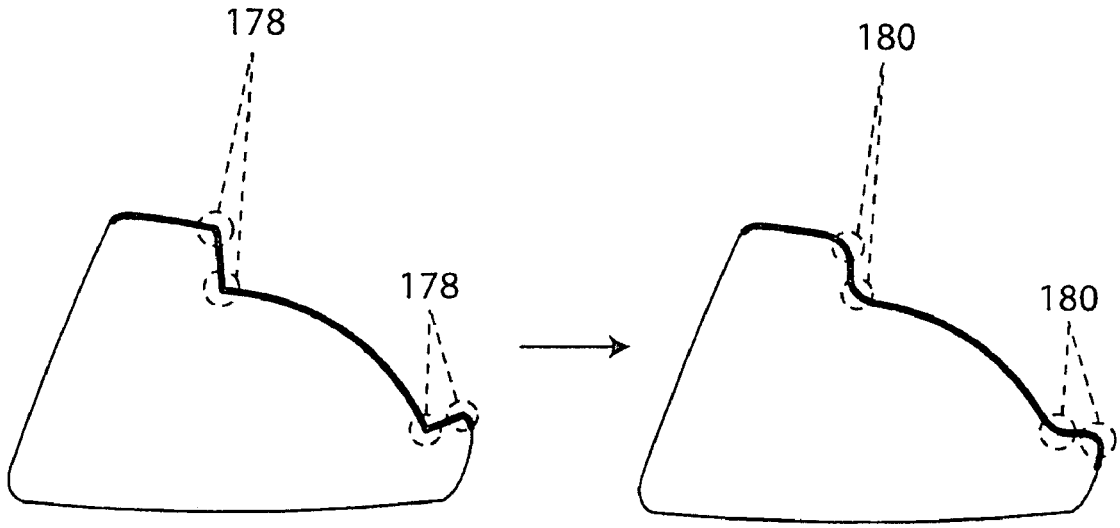
FIG. 7E is a heel side schematic view of the golf club of FIG. 7C.

Referring to FIGS. 7A and 7B, "articulation point," e.g., one of the articulation points 172, as used herein, denotes at least one point along a path 174 where the curvature of the path 174 changes from concave to convex or vice versa. The path 174 may be characterized as the intersection of an imaginary vertical plane 140 with the top portion of an exemplary club head 101. As shown in FIG. 7B, the vertical plane 140 is substantially perpendicular to the top edge 107 and passes through the face center 112. Referring back to FIG. 7A, the path 174 is bounded by the center apex 138 and a rear-most point 149. When determining whether the path 174 changes curvature, it is assumed that all non-arcuate junctions along the path 174 are arcuate. For example, each non-arcuate junction 178 of club head 153, illustrated in FIG. 7C, is assumed to be substituted with an imaginary junction 180, having an infinitesimally small radius, as shown in FIGS. 7D and 7E.

Figure 15:
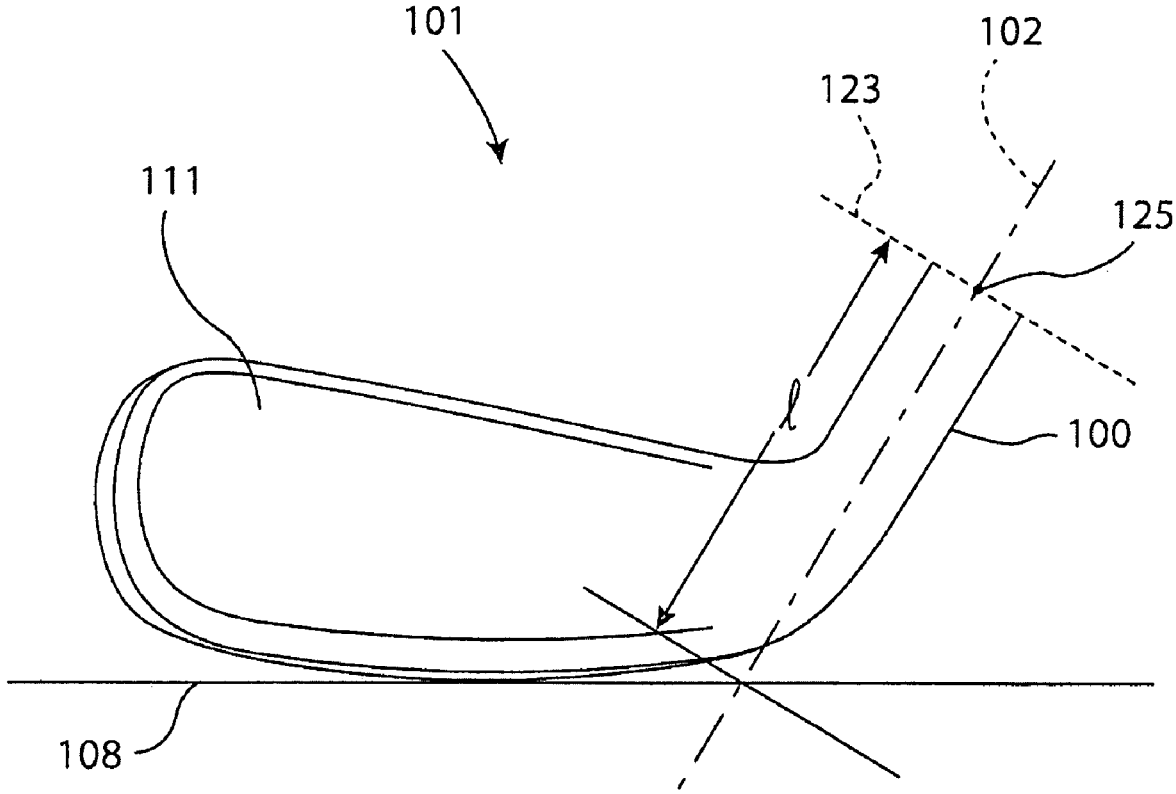
FIG. 15 is a front elevational view of an exemplary golf club in accordance with another aspect of the invention.

Referring to FIG. 15, "hosel center," e.g., the hosel center 125, as used herein, refers to the point of intersection between an imaginary planar surface 123 and the hosel centerline 102. The planar surface 123 is characterized by the terminus of the hosel 100.

Referring again to FIG. 15, "hosel length," as used herein, denotes a distance between the hosel center 125 and the ground plane 108 along the hosel centerline 102.

The term "discretionary mass," as used herein, denotes the difference between a target mass and a minimum structural mass required to form the club head.

The term "volume" is defined in accordance with the USGA and R&A Rules Limited, "Procedure for Measuring the Club Head Size of Wood Clubs," Revision 1.0, Section 5 (Nov. 21, 2003).

The terms "set of golf clubs," "golf club set" and "set," as used herein, each refers to a plurality of golf clubs that (a) may have similar design, ornamental and/or brand characteristics, and (b) are intended for original sale as a set or a short set.

Referring to FIGS. 1-15, exemplary golf clubs in accordance with one or more of the aspects of the present invention are shown and described.

Figure 11A:
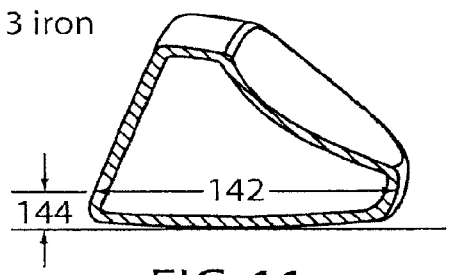
FIGS. 11A-11H are heel side cross-sectional views of an exemplary set of golf clubs in accordance with another aspect of the invention.
Figure 11B:
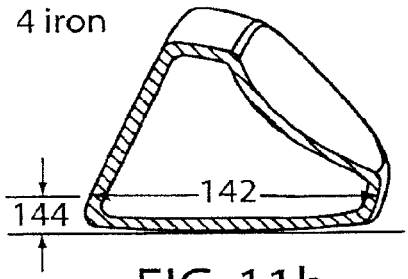
Figure 11C:
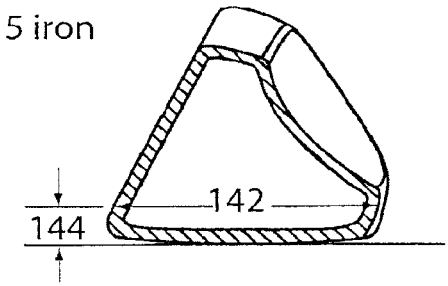
Figure 11D:
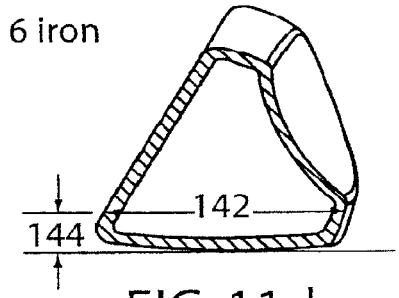
Figure 11E:
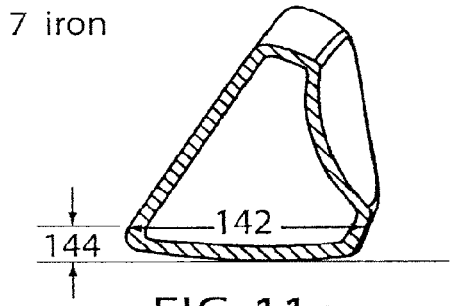
Figure 11F:
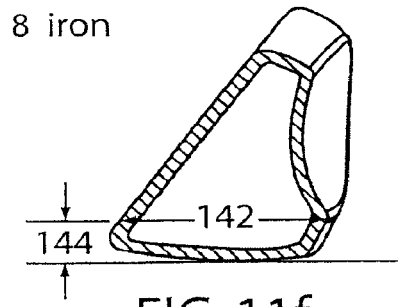
Figure 11G:
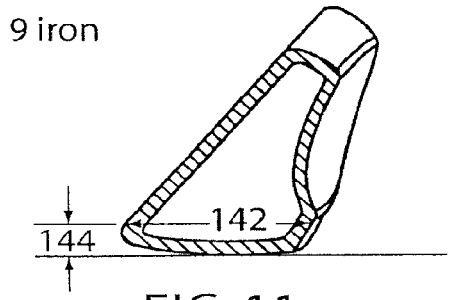
Figure 11H:
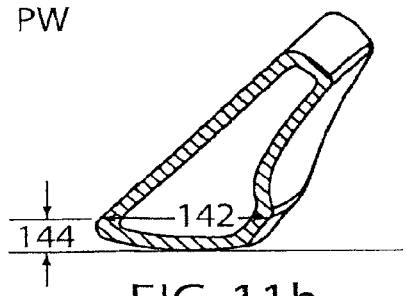

An improved set of hollow iron-type golf clubs according to one aspect of the invention may be realized by increasing the transverse dimension of the golf club head. The large transverse dimension provides improved bounce characteristics which can significantly decrease the "digging in" effect associated with the traditional iron-type club heads. As shown in FIGS. 11A-11H, the transverse dimension 142 may vary significantly throughout the set between, e.g., the three iron (FIG. 11A) and the pitching wedge (FIG. 11H).

In addition to improving the bounce characteristics of an iron set, the enlarged transverse dimension may improve the depth of the center of gravity. More specifically, the center of gravity may become progressively deeper as the transverse dimension becomes progressively greater throughout the set. Referring to FIG. 2, the location of the center of gravity CG may be represented by a distance d, between the center of gravity and the sweet spot 134. As the transverse dimension 142 (FIG. 5) progressively increases throughout the set, e.g., from the higher-lofted clubs to the lower-lofted clubs, the distance d (FIG. 2) also increases. Referring once again to FIG. 2, a club head having a "deep" center of gravity CG relative to the hosel axis 102 dynamically flexes the shaft toward alignment with the club head's center of gravity on the downswing to dynamically loft and square the striking surface 111 at impact with the ball. The striking surface 111 that is square and more lofted at impact facilitates effective ball launches and accurate shots. The lower lofted clubs, which are generally more difficult to hit, utilize this feature to a greater extent to realize a more forgiving set of golf clubs.

The increased radius of rotation associated with a "deep" center of gravity, i.e., a relatively greater distance between center of gravity and the point of contact between the ball and the striking surface of the club head, may also improve ball launch conditions associated with off-center hits for the following reasons. The torque generated by an off-center hit results in the club head rotating about the center of gravity. If the center of gravity is "deep," the club head will tend to rotate less compared to a club head whose center of gravity is closer to the striking surface. Accordingly, the increased radius of rotation of a club head with a "deep" center of gravity may improve the speed and directional characteristics of a ball in the event of an off-center hit.

Figure 12:
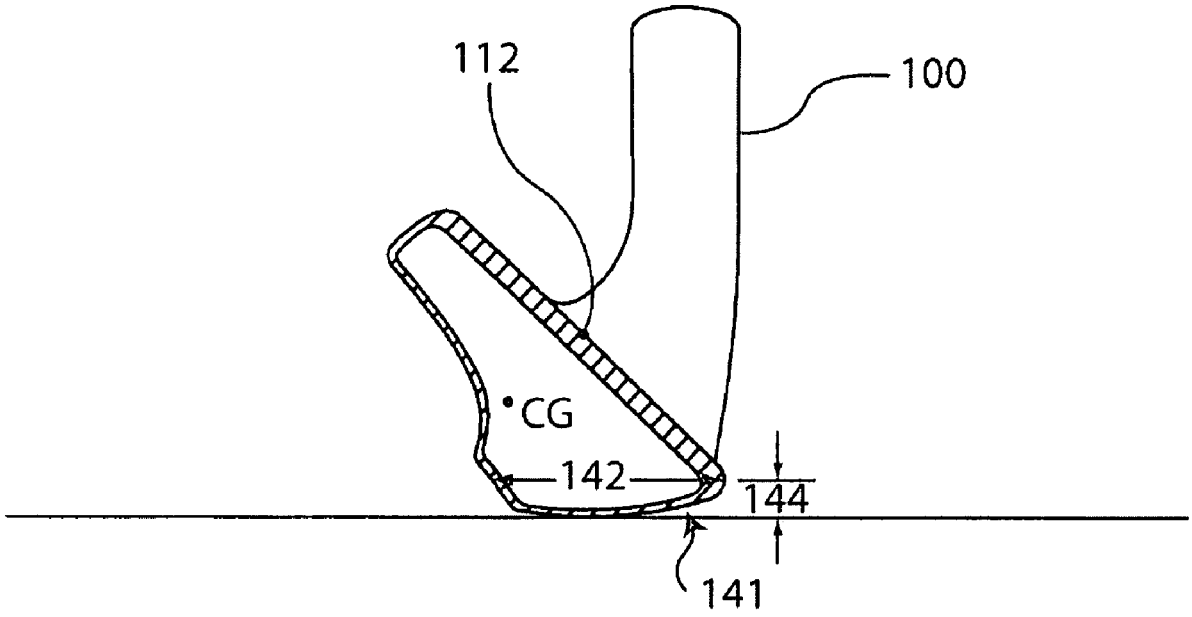
FIG. 12 is a toe side cross-sectional view of the golf club of FIG. 11H.

Other factors may also affect the location of the center of gravity throughout a club set. For example, as clubs within the set increase in loft, the center of gravity tends to shift toward the toe of the club head. As the center of gravity moves toward the toe of the club head, a progressive decrease in directional shot consistency occurs due to a statistically unfavorable ball-contact distribution pattern. For higher lofted clubs, the natural tendency of the golfer to strike the ball about the face center, on average, results in a larger-than-desired distance between the ball impact location on the striking surface and the sweet spot. This increased distance exaggerates both the head rotation and gear effect of the club head at ball impact, causing a loss of carry distance and accuracy. To counteract the unfavorable center-of-gravity shift described above, the hosel length (see FIG. 15) may be progressively extended with increasing loft from, e.g., the 3 iron (FIG. 10) to the pitching wedge (FIG. 12). Maintaining the face-centered location of the center of gravity for higher-lofted irons allows the sweet-spot placement to favorably remain substantially constant throughout the set.

Figure 10:
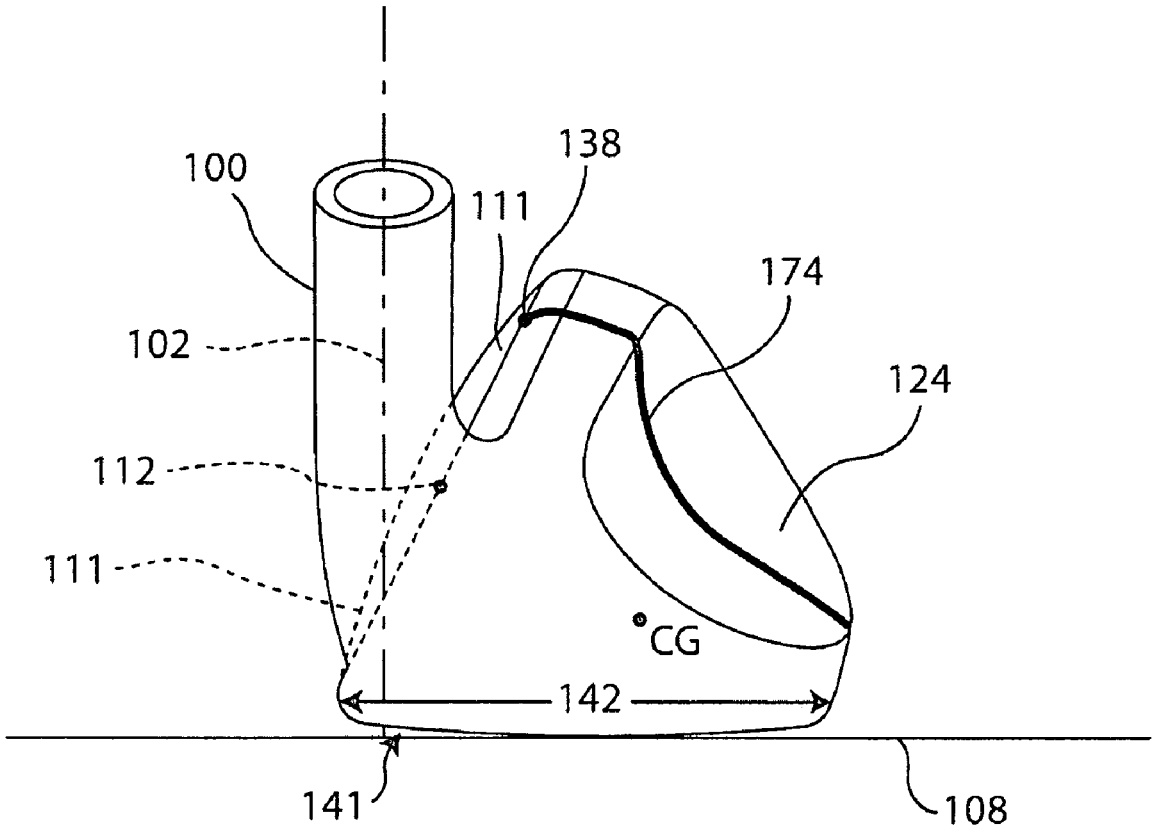
FIG. 10 is a heel side elevational view of an exemplary golf club in accordance with another aspect of the invention.

In one example of the invention, the geometry of the shell 124 (FIG. 3) may be altered to reduce the weight of the club head so that a favorable swing weight may be realized. For example, as shown in FIGS. 7A and 10, by utilizing at least two articulation points 172, a concave crown shape promoting improved mass properties of the club head may be achieved. Since the concave crown shape may reduce the volume of the club head as well as the amount of material needed to form the club head, more material may be utilized to increase the transverse dimension 142. Thus, a golf club head having a relatively large transverse dimension 142, as well as a favorable swing weight, may be implemented. It should be appreciated that the articulation points 172 may be situated anywhere along the path 174. The location of the articulation points 172 need not be limited by the examples shown in FIGS. 7A and 10.

The shell 124 (FIG. 3) having the articulation points 172 (FIG. 7A) located as proposed above may also be used to increase the discretionary mass of one or more clubs in an exemplary set according to the invention. Such club head construction allows the mass to be redistributed from the top portion of the club head to a more favorable location in the head. Accordingly, mass may be redistributed, e.g., to improve the inertial properties of the club head and/or the center of gravity location.

The club head shape may also influence the acoustic properties of the golf club head at ball impact. The sound produced by a golf club head at ball impact may have a significant psychological effect on the player's confidence and performance. Many golfers correlate a pleasing sound at ball impact with superior performance and a poor sound with inferior performance. Accordingly, one or more club heads of an exemplary set of clubs in accordance with one aspect of the invention may include an internal constraining member that improves the club head acoustic characteristics at ball impact by promoting favorable vibrational frequencies.

Figure 14:
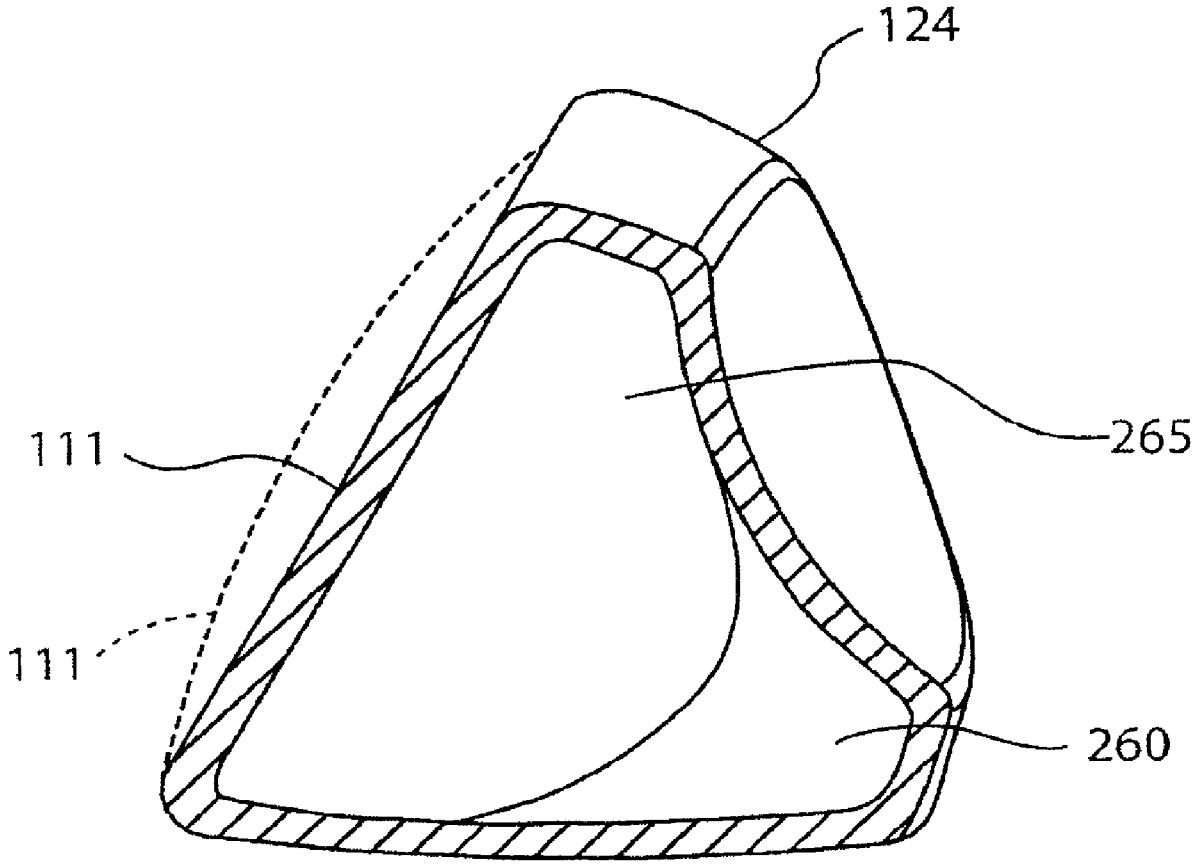
FIG. 14 is a heel side cross-sectional view of an exemplary golf club in accordance with another aspect of the invention.

For example, as shown in FIG. 14, an interior cavity 265 of the club head may contain a constraining member 260 which is positioned and configured to stiffen the golf club head. The member 260 improves the club head's acoustic properties at impact with the ball by promoting favorable vibrational frequencies pleasing to the golfer.

The constraining member 260, shown in FIG. 14, is within the cavity 265 of the club head and comprises a rib. However, it should be appreciated that the constraining member 260 may have different configurations and may be associated with the club head in a variety of ways, i.e., the configuration and location of the constraining member 260 need not be limited by the example shown in FIG. 14.

Figure 13:
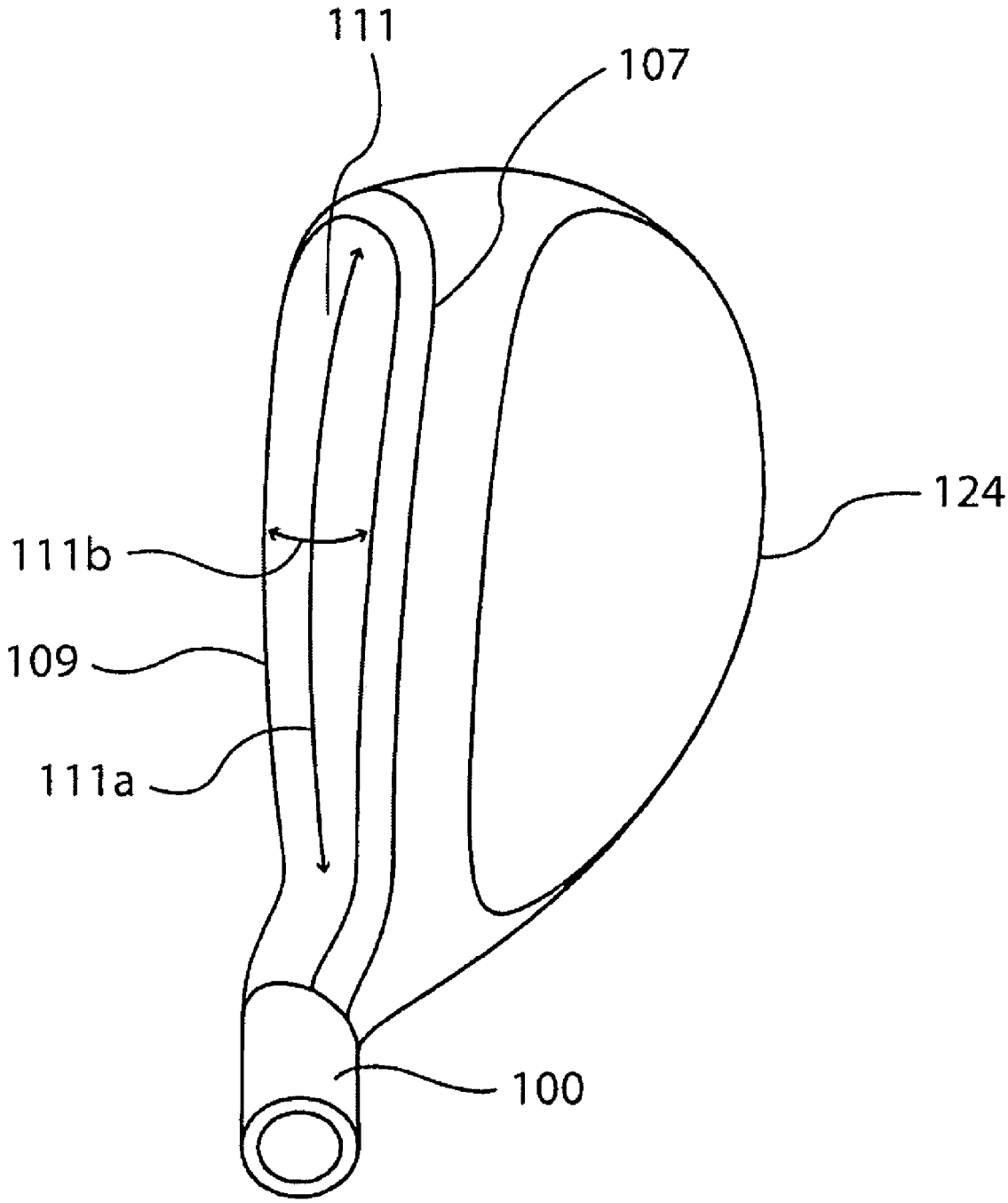
FIG. 13 is a top plan view of an exemplary golf club in accordance with another aspect of the invention.

Referring to FIGS. 10, 13, and 14, an iron-type golf club set according to one aspect of the present invention may also utilize a bulge 111*a* and a roll 111*b* on the striking surface of one or more selected club heads in the set to improve the overall performance of the set. As shown in FIG. 13, a bulge 111*a* comprises a curvature in the heel-to-toe direction of the striking surface 111', causing the striking surface 111' to bow outward in the central portion. A roll 111*b* comprises a curvature in the top-to-bottom direction, i.e., from the top edge 107 to the bottom edge 109 of the striking surface 111'. The bulge 111*a* and the roll 111*b* help compensate for undesirable spin characteristics associated with the "gear effect" phenomenon that may be associated with an off-center hit. Accordingly, the "sweet" area of the striking surface 111' is enlarged, resulting in improved accuracy and distance.

Figure 8:
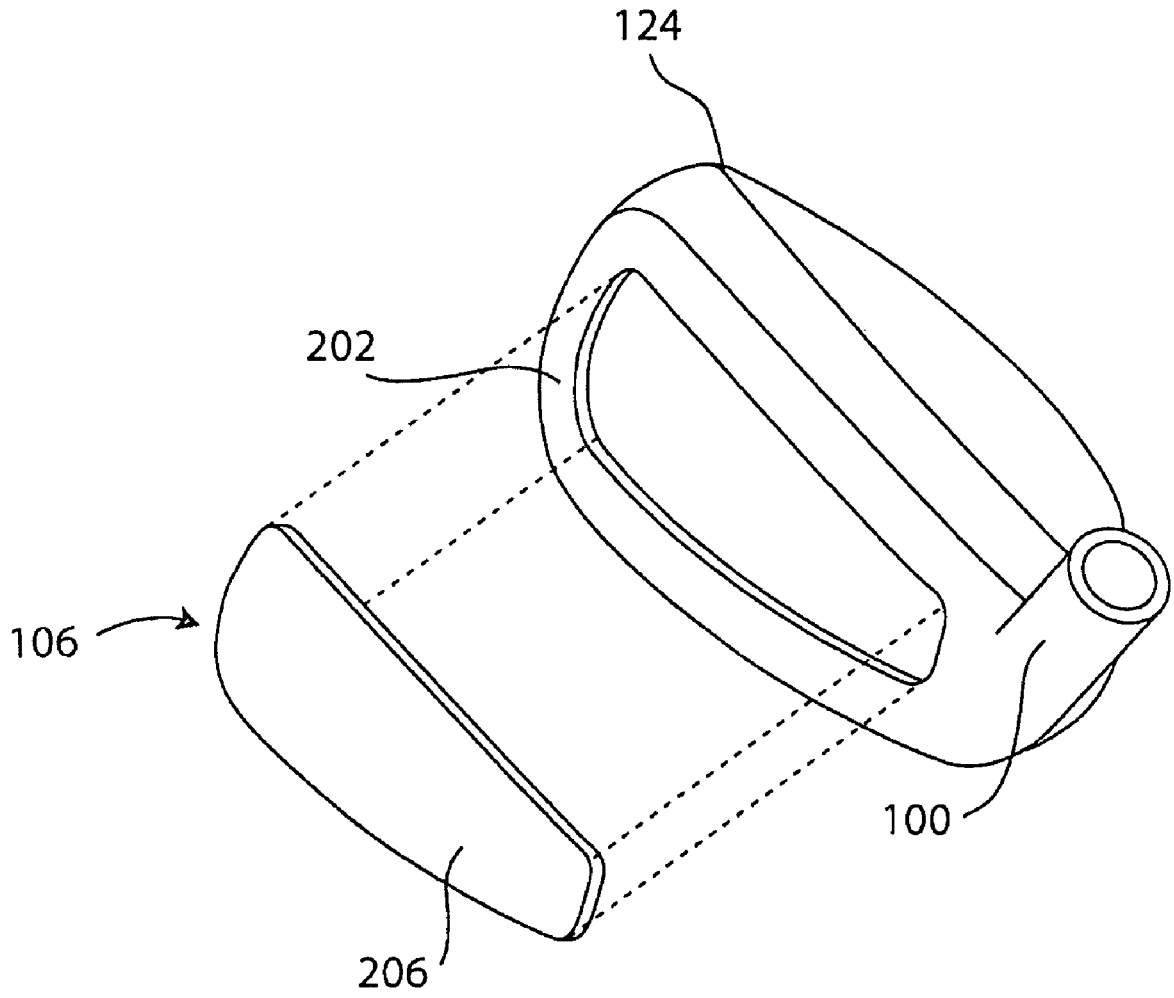
FIG. 8 is an exploded view of an exemplary golf club in accordance with another aspect of the invention.
Figure 9B:
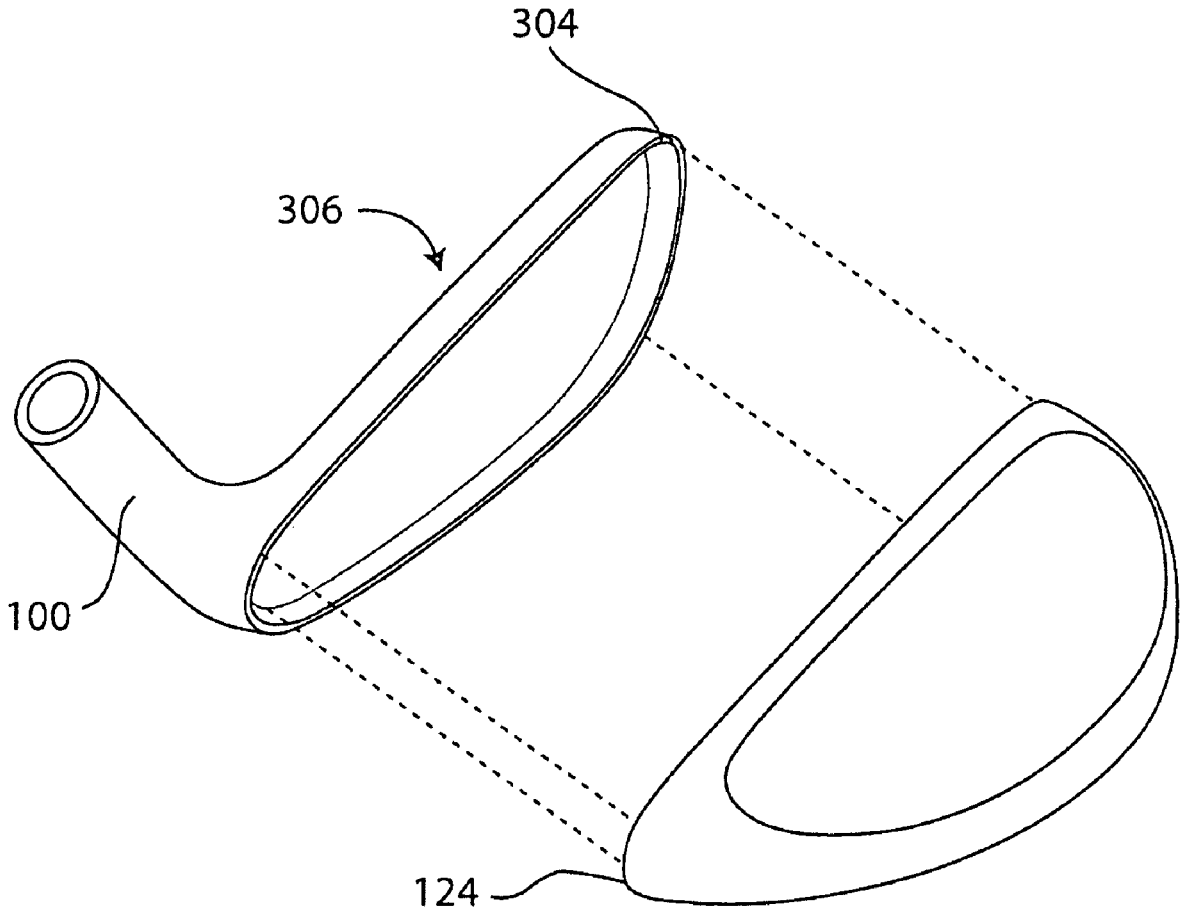

As shown in FIGS. 8, 9A, and 9B, the face member 106 may, for example, be attached to the rest of the club head by either welding a thin strike plate 206 to a peripheral edge 202 of the shell 124 or by welding a cup face 306 to a peripheral edge 302. The edge 302 may be located up to about 25 mm from the center apex 138 in a direction substantially perpendicular to a striking surface of the cup face 306. Utilizing a thin strike plate 206 improves the club head's coefficient of restitution, resulting in increased ball-carry distances. The cup face 306, which is relatively inexpensive to produce, may include the hosel 100 and a protruding portion 304.

Accordingly, an improved set of irons consistent with one or more of the exemplary aspects of the invention may be realized by utilizing a variety of manufacturing techniques, thus allowing to lower production costs when necessary.

The following are exemplary sets of golf clubs in accordance with one or more aspects of the invention.

EXAMPLE 1

In a first exemplary set of golf clubs, each club of the set may include a club head comprising a shell, a face member comprising a striking surface, a loft of at least 20°, and a transverse dimension at a vertical height between about 2 mm and about 10 mm above a ground plane. At least three club heads of the set may have an average volume between about 75 $cm^3$ and about 90 $cm^3$, with each club head having a different volume. Preferably, the transverse dimensions of the at least three club heads progressively decrease from the highest-volume club head to the lowest-volume club head.

Each face member may further include either a strike plate that may be attached to the shell at a first peripheral edge or a cup face that may be attached to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface for improved performance.

At least two club heads may comprise a cavity at least in part bounded by the shell and the face member and at least one club head may comprise a constraining member in the cavity. The shell of at least two club heads may further include a concavity comprising at least two articulation points.

EXAMPLE 2

In a second exemplary set of golf clubs, each club of the set may include a club head comprising a shell, a face member comprising a striking surface, a loft of at least 20°, and a transverse dimension at a vertical height between about 2 mm and about 10 mm above a ground plane. At least three club heads of the set may have different lofts and the transverse dimensions of the at least three club heads may progressively decrease from the lowest-lofted club head to the highest-lofted club head.

Each face member may further include either a strike plate that may be attached to the shell at a first peripheral edge or a cup face that may be attached to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface for improved performance.

At least two club heads may comprise a cavity at least in part bounded by the shell and the face member and at least one club head may comprise a constraining member in the cavity. The shell of at least two club heads may further include a concavity comprising at least two articulation points.

Each club head of the set may further comprise a hosel having a hosel length. The hosel lengths of the at least three club heads may progressively increase from the lowest-lofted club head to the highest-lofted club head

EXAMPLE 3

In a third exemplary set of golf clubs, each club of the set includes a club head comprising a shell having a concave portion, a face member comprising a striking surface, and a loft of at least 20°. At least three club heads of the set may have different lofts and at least two club heads may have a loft less than about 30°.

Each face member may further include either a strike plate that may be attached to the shell at a first peripheral edge or a cup face that may be attached to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface of at least two club heads for improved performance.

At least two club heads may comprise a cavity at least in part bounded by the shell and the face member and at least one club head may comprise a constraining member in the cavity. The shell of at least two club heads may further include a concavity comprising at least two articulation points.

Each club head of the set may further comprise a hosel having a hosel length. The hosel lengths of at least three club heads may progressively increase from the lowest-lofted club head to the highest-lofted club head

EXAMPLE 4

In a fourth exemplary set of golf clubs, each club of the set may include a club head comprising a shell portion having a concavity, a face member comprising a striking surface, a cavity at least in part bounded by the shell and the face member, and a loft of at least 20°. At least three club heads of the set may have different lofts and at least two club heads may have a loft that is greater than about 30°.

Each face member may further include either a strike plate that may be attached to the shell at a first peripheral edge or a cup face that may be attached to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface of at least two club heads for improved performance.

At least one club head of the set may comprise a constraining member in the cavity with the club head having a first resonant frequency of vibration between about 3,000 Hz and about 7,000 Hz.

Each club head of the set may further comprise a hosel having a hosel length. The hosel lengths of at least three club heads may progressively increase from the lowest-lofted club head to the highest-lofted club head.

EXAMPLE 5

In a fifth exemplary set of golf clubs, each club of the set may include a club head having a shell, a face member comprising a striking surface, a center of gravity, a sweet spot located a linear distance from the center of gravity, and a loft of at least 20°. At least three club heads of the set may have different lofts.

Each face member may further include either a strike plate that may be attached to the shell at a first peripheral edge or a cup face that may be attached to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface of at least two club heads for improved performance.

The linear distances between the sweet spot and the center of gravity of the at least three club heads may progressively decrease from the lowest-lofted club head to the highest-lofted club head. The linear distance may be between about 16 mm and about 20 mm for at least one first club head of the set, between about 11 mm and about 16 mm for at least one second club of the set, and between about 6 mm and about 11 mm for at least one third club head of the set.

Each club head of the set may further comprise a hosel having a hosel length. The hosel lengths of at least three club heads may progressively increase from the lowest-lofted club head to the highest-lofted club head.

EXAMPLE 6

In a sixth exemplary set of golf clubs, each club of the set may include a club head comprising a loft of at least 20°, a shell, a face member comprising a striking surface, a center of gravity, and a sweet spot located a linear distance from the center of gravity. The linear distance may be between about 16 mm and about 20 mm for at least one first club head of the set, between about 11 mm and about 16 mm for at least one second club head of the set, and between about 6 mm and about 11 mm for at least one third club head of the set. The at least one first club head may comprise a loft between about 20° and about 27°, the at least one second club head may comprise a loft between about 27° and about 39°, and the at least one third club head may comprise a loft greater than about 39°. At least three club heads of the set may have different lofts.

Each face member may further include either a strike plate that may be attached to the shell at a first peripheral edge or a cup face that may be attached to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface of at least two club heads for improved performance.

Each club head of the set may further comprise a hosel having a hosel length. The hosel lengths of at least three club heads may progressively increase from the lowest-lofted club head to the highest-lofted club head.

EXAMPLE 7

In a seventh exemplary set of golf clubs, each club of the set may include a club head comprising a shell portion, a face member comprising a striking surface, a cavity at least in part bounded by the shell and the face member, and a loft of at least 20°. At least three club heads of the set may have different lofts Each face member may further include either a strike plate that may be welded to the shell at a first peripheral edge or a cup face that may be welded to the shell at a second peripheral edge. Preferably, at least one club of the set will incorporate the strike plate and at least two clubs will incorporate the cup face. For club heads having a loft between 20° and 47°, at least one club of the set will generally have a first face thickness and at least one club of the set will generally have a second face thickness, where the second face thickness is greater than the first face thickness. It is also desirable to include a bulge and a roll on the striking surface of at least two club heads for improved performance.

Each club head of the set may further comprise a hosel having a hosel length. The hosel lengths of at least three club heads may progressively increase from the lowest-lofted club head to the highest-lofted club head.

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

What is claimed is:

1. A set of golf clubs, each club of the set including a club head comprising:

a shell;

a face member comprising a striking surface;

a loft of at least 20°; and a transverse dimension at a vertical height between about 2 mm and about 10 mm above a ground plane;

at least two club heads of the set comprising a cavity having a stiffening rib that is disposed in the cavity and dissociated from the face member, the cavity at least in part bounded by the shell and the face member; and at least three club heads of the set having different lofts, the transverse dimensions of the at least three club heads progressively decreasing from the lowest-lofted club head to the highest-lofted club head, at least one club head of the set comprising at least two articulation points.

2. The set of claim 1, wherein:

the shell of each of at least three club heads comprises a concavity, and the striking surface of each of at least two club heads comprises a bulge and a roll.

3. The set of claim 1, wherein:

the face member of at least one club head comprises a strike plate coupled to the shell at a first peripheral edge, and the face member of each of at least two club heads comprises a cup face coupled to the shell at a second peripheral edge.

4. The set of claim 1, wherein:

each of the at least three club heads further comprises a hosel having a hosel length, the hosel lengths of the at least three club heads progressively increasing from the lowest-lofted club head to the highest-lofted club head, and the striking surface of at least one club head comprises a bulge and a roll.

5. The set of claim 1, wherein:

the face member of at least one first club head has a loft between 20° and 47° and comprises a first face thickness, and the face member of at least one second club head has a loft between 20° and 47° and comprises a second face thickness, the second face thickness being greater than the first face thickness.

* * * * *